US005920295A

United States Patent [19]

Takahashi et al.

[11] Patent Number: 5,920,295

[45] Date of Patent: Jul. 6, 1999

[54] MEMORY DRIVE SYSTEM OF A DC TYPE OF PLASMA DISPLAY PANEL

[75] Inventors: Atsushi Takahashi; Shigeru Takasaki; Yoshihiko Kobayashi; Yuji Terouchi, all of Tokyo, Japan

[73] Assignee: OKI Electric Industry Co., Ltd., Tokyo, Japan

[21] Appl. No.: 08/825,101

[22] Filed: Mar. 27, 1997

[30] Foreign Application Priority Data

Jun. 26, 1996 [JP] Japan ..... 8-166362

[51] Int. Cl.[6] ..... G09G 3/28

[52] U.S. Cl. ..... 345/60; 345/66; 345/68

[58] Field of Search ..... 345/60–72

[56] References Cited

U.S. PATENT DOCUMENTS

| | | | |
|---|---|---|---|
| 4,162,427 | 7/1979 | Kamegaya et al. | 345/72 |
| 5,436,634 | 7/1995 | Kanazawa | 345/60 |
| 5,572,230 | 11/1996 | Takano et al. | 345/68 |
| 5,670,975 | 9/1997 | Takano et al. | 345/60 |
| 5,739,799 | 4/1998 | Takahashi et al. | 345/68 |
| 5,744,909 | 4/1998 | Amano | 313/585 |
| 5,790,087 | 8/1998 | Shigeta et al. | 345/62 |

FOREIGN PATENT DOCUMENTS

| | | |
|---|---|---|
| 0 160 455 A2 | 6/1985 | European Pat. Off. . |
| 0709 820 A2 | 1/1996 | European Pat. Off. . |
| 6-149176 | 5/1994 | Japan . |

OTHER PUBLICATIONS

Y. Takano et al: "A 40–in DC–PDP with New Pulse–Memory Drive Scheme" Digest of Technical Papers, 1994 SID International Symposium, Jun. 14–16, 1994, vol. 25 pp. 731–734, San Jose, US, XP002016392.

*Primary Examiner*—Mark K. Zimmerman
*Assistant Examiner*—Vincent E. Kovalick
*Attorney, Agent, or Firm*—Venable; Norman N. Kunitz

[57] ABSTRACT

In a memory drive system of a DC type of plasma display panel, scan signals are applied to scan electrodes connected to the DC type of plasma display panel, with the scan signals each comprising a priming scan pulse for generating the priming discharge, a write scan pulse for generating the write discharge, and a sustain pulse train for generating the sustain discharge. The priming scan pulse, the write scan pulse and the sustain pulse train are sequentially shifted on a time basis for each scan signal. To each of the data electrodes connected to the DC type of plasma display panel, a data signal is applied in which, only when the write discharge is not to be generated, is a non-write pulse formed, which offers a turn-off level during an applying period of time for the write scan pulse, and which maintains a turn-on level when the write discharge is to be generated and during other periods of time except the applying period of time for the write scan pulse.

4 Claims, 9 Drawing Sheets

$V_H$(100V)
$V_L$(0V)
$V_b$(−100V)
$V_{SUS}$(−115V)
$P_{SUS}$
$V_{SUS}$
$T_{SCN}$
$P_{WRT}$
(−240V)
$P_{WRT}$
$V_{WRT}$
$P_{NW}$
(−190V)
$T_0$
$P_{PR}$
$V_{PR}$
$T_{SCN}$
tw
tps
$S13_1 \sim S13_J$
$S12_i$
$S12_{i+1}$
$S12_{i+2}$
TIME $V_H$(100V)
$V_L$(0V)
$V_b$(−100V)
$V_{SUS}$(−115V)
$P_{SUS}$
(−240V)
$V_{SCN}$
$P_{NW}$
$P_{WRT}$
$P_{PR}$
$T_{SCN}$
tps
tw
$S13_1 \sim S13_J$
$S22_i$
$S22_{i+1}$
$S22_{i+2}$
TIME

MEMORY DRIVE SYSTEM OF A DC TYPE OF PLASMA DISPLAY PANEL

BACKGROUND OF THE INVENTION

1. Field of the Invention

The present invention relates to a memory drive system of a d.c. (direct current) type of plasma display panel (DC-PDP).

2. Description of the Background Art

Hitherto, as the state of the field, there is published a document: Hiroshi Murakami, et al., "Study on a Color Graphic Gas-Discharge Pulse Memory Panel", Transactions of The Institute of Electronics, Information and Communication Engineers of Japan, C-II, Vol. J73-C-II, No. 11, pp. 794–802 (November 1990).

FIG. 2 is a perspective illustration of a conventional DC-PDP shown in the above-referenced document. In the figure, the DC-PDP is arranged between a rear plate 1 and a front plate 2. On the rear plate 1, there are formed a plurality of cathodes $\mathbf{3}_1$-$\mathbf{3}_I$ (I is a positive integer) which are arranged substantially in parallel with one another. Each of the cathodes $\mathbf{3}_1$-$\mathbf{3}_I$ is a linear electrode. On the front plate 2, there are formed a plurality of anodes $\mathbf{4}_1$-$\mathbf{4}_J$ (J is also a positive integer) which are arranged substantially in parallel with one another. Each of the anodes $\mathbf{4}_1$-$\mathbf{4}_J$ is a linear electrode. The cathodes $\mathbf{3}_1$-$\mathbf{3}_I$ and the anodes $\mathbf{4}_1$-$\mathbf{4}_J$ are located over and adjacent each other in an intersecting relation. A barrier 5 is interposed between the rear plate 1 and the front plate 2 to provide a certain interval therebetween. A mixed gas of, for example, helium (He) and xenon (Xe), as the discharge gas, is enclosed between the rear plate 1 and the front plate 2.

There are provided discharge cells 6 at the cross points of the cathodes $\mathbf{3}_1$-$\mathbf{3}_I$ and the anodes $\mathbf{4}_1$-$\mathbf{4}_J$. That is, a plurality of discharge cells 6 is arranged as a matrix. A phosphor 7 is disposed for each discharge cell 6 in each of the areas in which the front plate 2 is adjacent to the respective anodes $\mathbf{4}_1$-$\mathbf{4}_J$. The respective discharge cells 6 are partitioned by the barrier 5. In the barrier 5 partitioning the adjacent discharge cells 6, there are formed cutting sections in a direction, to which each of the linear anodes extends, to provide priming slits 8 each serving as a space for coupling the adjacent discharge cells 6 to one another.

FIG. 3 is a time chart showing drive waveforms for the DC-PDP shown in FIG. 2. The reference letter $A_j$ ($1 \leqq j \leqq J$) shown in FIG. 3 denotes voltage waveforms to be applied to the anode $\mathbf{4}_j$; and $K_i$ ($1 \leqq i \leqq I$) and $K_{i+1}$ denote voltage waveforms to be applied to the cathodes $\mathbf{3}_i$ and $\mathbf{3}_{i+1}$, respectively. Always applied to the anode $\mathbf{4}_j$ are a bias voltage $V_A$ (e.g. 60 volts (V)) and a voltage $V_{SP}$ (e.g. 135 V) of a sustain pulse (SP) train of a period T. Similarly, the bias voltage $V_A$ and the voltage $V_{SP}$ of the sustain pulse (SP) train are applied to other anodes $\mathbf{4}_1$ to $\mathbf{4}_{j-1}$ and $\mathbf{4}_{j+1}$ to $\mathbf{4}_J$. On the other hand, an auxiliary pulse AK of a peak voltage $V_{AK}$ (e.g. −230 V) is applied to the cathode $\mathbf{3}_i$.

When a potential between the anode $\mathbf{4}_j$ and the cathode $\mathbf{3}_i$ becomes 290 V of the discharge voltage by application of the auxiliary pulse AK to the cathode $\mathbf{3}_i$, a short period of priming discharge occurs forcibly, first, in a line of discharge cells 6. Subsequently, the sequential application of the auxiliary pulse AK to the adjacent cathodes $\mathbf{3}_{i+1}$, $\mathbf{3}_{i+2}$, . . . causes the priming discharge to sequentially shift. At that time, the charged particles diffuse through the priming slit 8 to the adjacent discharge cell 6. This brings about such a condition that the discharge additionally is easy to take place in the adjacent discharge cell 6. Thus, a stable shift of the priming discharge can be realized. After application of the auxiliary pulse AK to the cathodes, the potential of the cathode $\mathbf{3}_i$ is set up to 0 V so as to prevent the discharge. In this manner, the charged particles within the discharge cell are reduced with the passage of time.

After an erasing condition is maintained during a period of time $T_0$, an anode write pulse WA is applied to the anode $\mathbf{4}_j$, and simultaneously, a cathode write pulse WK is applied to the cathode $\mathbf{3}_i$. A voltage $V_{WA}$ of the anode write pulse WA is, for example, 110 V, and a voltage $V_{WK}$ of the cathode write pulse WK is, for example, −230 V. The discharge cell 6, to which both the anode write pulse WA and the cathode write pulse WK are applied, form a write discharge. This write discharge is formed promptly, since the charged particles created in the priming discharge before time $T_0$ remain in the discharge cell 6. When the write discharge is terminated, a voltage $V_M$ (e.g. −80 V) is applied to the cathode $\mathbf{3}_i$.

While the charged particles created in the write discharge are gradually decreased with the passage of time, a lot of charged particles still remain in the discharge cell 6 immediately after the write discharge. It is thus possible to form a discharge even with a voltage lower than a write discharge voltage. Specifically, after the write discharge, a discharge is formed even with a sustained discharge voltage ($V_{SP}-V_M=$ 215 V) lower than the write discharge voltage ($V_{WA}-V_{WK}=$ 340 V), so that a sustain discharge is continued on a pulse basis by the sustain pulses SP of the anode $\mathbf{4}_j$ and the voltage $V_M$ of the cathode $\mathbf{3}_i$.

When the sustain discharge is stopped, the voltage of the cathode $\mathbf{3}_i$ is forcibly set up to 0 V. On the other hand, in the discharge cell 6 to which no write pulse is applied, the charged particles almost disappear. Thus, the pulse discharge is not formed with a voltage lower than the write discharge voltage.

Control is provided such that a priming discharge period $\tau_T$, a writing discharge period $\tau_W$, $\tau_K$, and a period $\tau_{SP}$ of the sustain pulse SP do not overlap each other.

However, the conventional memory drive scheme of a DC-PDP involves the following drawbacks. According to the conventional memory drive scheme of a DC-PDP, even if voltage waveforms are applied to the respective cathodes $\mathbf{3}_{1+1}$, $\mathbf{3}_{i+1}$, . . . on a pulse shift basis, there is a need to adopt a time division on a period T of time in order to provide such a control that timings of the priming discharge, the writing discharge and the the sustain discharge do not overlap each other. This involves a limit in reducing an access time for a line. Thus, it will be difficult to provide a display of a sufficient gray level. Further, according to the conventional memory drive scheme of a DC-PDP, levels of a signal to be applied to the anode $\mathbf{4}_j$ take three values of a voltage $V_A$, a voltage $V_{WA}$ and a voltage $V_{SP}$, and levels of a signal to be applied to the cathode $\mathbf{3}_i$ also take three values of 0 V, a voltage $V_M$ and voltages $V_{AK}$, $V_{WK}$. Those voltages are selectively used on a changeover basis. This causes drive circuits for driving the cathodes $\mathbf{3}_1$-$\mathbf{3}_I$ and anodes $\mathbf{4}_1$-$\mathbf{4}_J$ to be complicated and obliged to be expensive. For example, in order to drive the respective cathodes $\mathbf{3}_1$-$\mathbf{3}_I$ and the respective anodes $\mathbf{4}_1$-$\mathbf{4}_J$ with three values, there are needed three transistors each having a high withstand voltage for each of the cathodes $\mathbf{3}_1$-$\mathbf{3}_I$ and the anodes $\mathbf{4}_1$-$\mathbf{4}_J$. This causes the drive circuits to be expensive.

SUMMARY OF THE INVENTION

It is therefore an object of the present invention to provide a memory drive system of a DC-PDP and a method of memory-driving a DC-PDP in accordance with which the following problems have been solved.

(1) A limit in reducing an access time for a line.

(2) The drive circuits are obliged to be expensive.

In order to solve the problems set forth above, according to the present invention, in a d.c. type of plasma display panel comprising a first plate and a second plate placed over and adjacent the first plate, a group of data electrodes constituting a plurality of linear electrodes arranged on the first plate in parallel with one another, a group of scan electrodes constituting a plurality of linear electrodes arranged on the second plate in such a manner that the scan electrode group is placed over and adjacent the data electrode group and is substantially perpendicular to the data electrode group, and a plurality of discharge cells disposed at intersections of the respective data electrodes and the respective scan electrodes, each of the plurality of discharge cells performing a priming discharge, a write discharge and a plurality of number of times of sustain discharge subsequent to the write discharge in accordance with a potential between an associated data electrode and an associated scan electrode, a discharge gas being enclosed between the first plate and the second plate and also within the respective discharge cells, a method of memory driving the plasma display panel comprising the steps of: sequentially applying to the scan electrodes scan signals each comprising a priming scan pulse for generating the priming discharge, a write scan pulse for generating the write discharge, with the write scan pulse occurring with a delay of a predetermined time with respect to the priming scan pulse, and a sustain pulse train for generating the sustain discharge, the sustain pulse train occurring with a delay of a predetermined time with respect to the write scan pulse, wherein the priming scan pulse, the write scan pulse and the sustain pulse train are sequentially shifted on a time basis for each scan signal; and applying to each of the data electrodes a data signal in which, only when the write discharge is not to be generated, a non-write pulse is formed, which offers a turn-off level during an applying period of time for the write scan pulse, and a turn-on level is maintained when the write discharge is to be generated and during another period of time other than the applying period of time for the write scan pulse.

According to the invention, a system of memory driving the plasma display panel, comprising the d.c. type of plasma display panel mentioned above, and a timing generator for sequentially applying to the scan electrodes scan signals each comprising a priming scan pulse for generating the priming discharge, a write scan pulse for generating the write discharge, with the write scan pulse occurring with a delay of a predetermined time with respect to the priming scan pulse, and a sustain pulse train for generating the sustain discharge, with the sustain pulse train occurring with a delay of a predetermined time with respect to the write scan pulse, and with the priming scan pulse, the write scan pulse and the sustain pulse train being sequentially shifted on a time basis for each scan signal, said timing generator applying to each of said data electrodes a data signal in which, only when the write discharge is not to be generated, a non-write pulse is formed, which offers a turn-off level during an applying period of time for the write scan pulse, and a turn-on level is maintained when the write discharge is to be generated and during another period of time except the applying period of time for the write scan pulse.

According to the present invention, on each of the scan signals to be applied to the scan electrodes, there are formed a priming scan pulse for generating the priming discharge, a write scan pulse for generating the write discharge, and a sustain pulse train. The scan signals are applied to the scan electrodes. A potential difference between the potential of the scan electrode and the potential of the data electrode may form a discharge. The data signal to be applied to the data electrode is a bi-level signal which offers a turn-off in an applying period of time of the write scan pulse only when the write discharge is not to be generated, and offers a turn-on level during another period of time. Thus, even in the case where the priming scan pulse, the write scan pulse and the sustain pulse train are sequentially shifted on a time basis for each scan signal, the priming discharge and the sustain discharge may be formed, if the timing of the non-write pulse on the data electrode and the timing of the priming scan pulse and the sustain pulse train are not coincident with each other. It is thus possible to solve the foregoing problems in accordance with the memory drive scheme of the d.c. type of plasma display panel according to the present invention.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

First embodiment

Figure 4:
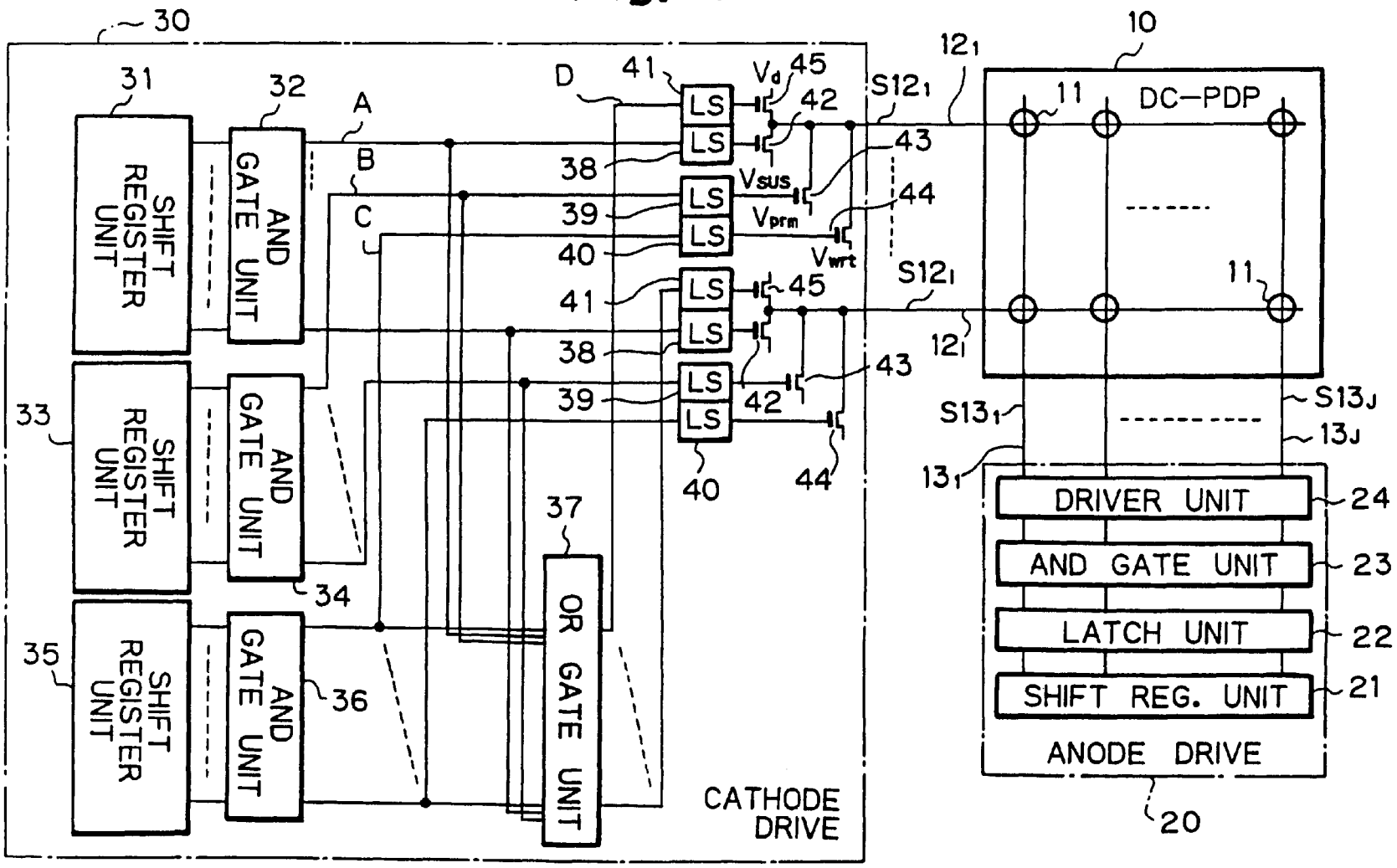
FIG. 4 is a schematic circuit diagram of a DC-PDP and drive circuits according to the first embodiment of the invention.

Referring to FIG. 4, which is a schematic circuit diagram of a d.c. (direct current) plasma display panel (DC-PDP) and drive circuits according to a first embodiment of the present invention, a DC-PDP 10 comprises a plurality of discharge cells 11. The discharge cells 11 are arranged in the form of a matrix at the respective intersections of a plurality of linear cathodes $\mathbf{12}_1$-$\mathbf{12}_I$, each of which serves as a scan electrode, and a plurality of linear anodes $\mathbf{13}_1$-$\mathbf{13}_J$, each of which serves as a data electrode.

Connected to the anodes $\mathbf{13}_1$-$\mathbf{13}_J$ is an anode drive circuit 20 for driving the anodes $\mathbf{13}_1$-$\mathbf{13}_J$ on a voltage basis. The anode drive circuit 20 comprises a shift register unit 21 for converting a serial input data to parallel data, a latch unit 22 connected to the shift register unit 21, an AND gate unit 23 for controlling drive timings for the anodes $\mathbf{13}_1$-$\mathbf{13}_J$, the AND gate unit 23 being connected to the output of the latch unit 22, and a driver unit 24 for applying a voltage to the anodes $\mathbf{13}_1$-$\mathbf{13}_J$, constituted of a CMOS, the driver unit 24 being connected to the output end of the AND gate unit 23. Thus, the anodes $\mathbf{13}_1$-$\mathbf{13}_J$ are driven on a voltage basis according to the input data, so that the discharge cells 11 connected to the anodes $\mathbf{13}_1$-$\mathbf{13}_J$ receive data signals $S\mathbf{13}_1$-$S\mathbf{13}_J$ via the anodes $\mathbf{13}_1$-$\mathbf{13}_J$, respectively.

The cathodes $\mathbf{12}_1$-$\mathbf{12}_I$ are connected to a cathode drive circuit 30 for applying scan signals $S\mathbf{12}_1$-$S\mathbf{12}_I$ to the cathodes $\mathbf{12}_1$-$\mathbf{12}_I$, respectively. The cathode drive circuit 30 comprises a shift register unit 31 for generating a plurality of timing signals A to form sustain pulses $P_{SUS}$ on the scan signals $S\mathbf{12}_1$-$S\mathbf{12}_I$, an AND gate unit 32 connected to the shift register unit 31, a shift register unit 33 for generating a plurality of timing signals B to form priming scan pulses $P_{PR}$ on the scan signals $S\mathbf{12}_1$-$S\mathbf{12}_I$, an AND gate unit 34 connected to the shift register unit 33, a shift register unit 35 for generating a plurality of timing signals C to form write scan pulses $P_{WRT}$ on the scan signals $S\mathbf{12}_1$-$S\mathbf{12}_I$, an AND gate unit 36 connected to the shift register unit 35, and an OR gate unit 37 for generating a plurality of timing signals D to set up a bias period of time, which will be described later, with the timing signals D being formed by a logical OR operation, namely a logical add of the signals A, B and C.

The AND gate unit 32 has outputs connected to a plurality of level shift (LS) circuits 38 each for converting the level of the associated signal A, the LS circuits 38 being associated with the cathodes $\mathbf{12}_1$-$\mathbf{12}_I$, respectively. The AND gate unit 34 has outputs connected to a plurality of level shift (LS) circuits 39 each for converting the level of the associated signal B, the LS circuits 39 being associated with the cathodes $\mathbf{12}_1$-$\mathbf{12}_I$, respectively. The AND gate unit 36 has outputs connected to a plurality of level shift (LS) circuits 40 each for converting the level of the associated signal C, the LS circuits 40 being associated with the cathodes $\mathbf{12}_1$-$\mathbf{12}_I$, respectively. The OR gate unit 37 has outputs connected to a plurality of level shift (LS) circuits 41 each for converting the level of the associated signal D, the LS circuits 41 being associated with the cathodes $\mathbf{12}_1$-$\mathbf{12}_I$, respectively.

Each of the level shift (LS) circuits 38 has an output connected to an associated one of the high withstand voltage transistors 42 for controlling turn-on and turn-off between the cathodes $\mathbf{12}_1$-$\mathbf{12}_I$ and a sustain pulse potential $V_{SUS}$ (e.g. −115 V) in accordance with the signal A subjected to the level conversion. Each of the level shift (LS) circuits 39 has an output connected to an associated one of the high withstand voltage transistors 43 for controlling turn-on and turn-off between the cathodes $\mathbf{12}_1$-$\mathbf{12}_I$ and a priming discharge potential $V_{PR}$ (e.g. −190 V) in accordance with the signal B subjected to the level conversion. Each of the level shift (LS) circuits 40 has an output connected to an associated one of the high withstand voltage transistors 44 for controlling turn-on and turn-off between the cathodes $\mathbf{12}_1$-$\mathbf{12}_I$ and a write discharge potential $V_{WRT}$ (e.g. −240 V) in accordance with the signal C subjected to the level conversion. Each of the level shift (LS) circuits 41 has an output connected to an associated one of the high withstand voltage transistors 45 for controlling turn-on and turn-off between the cathodes $\mathbf{12}_1$-$\mathbf{12}_I$ and a bias potential $V_b$ (e.g. −100 V) in accordance with the signal D subjected to the level conversion.

Figure 2:
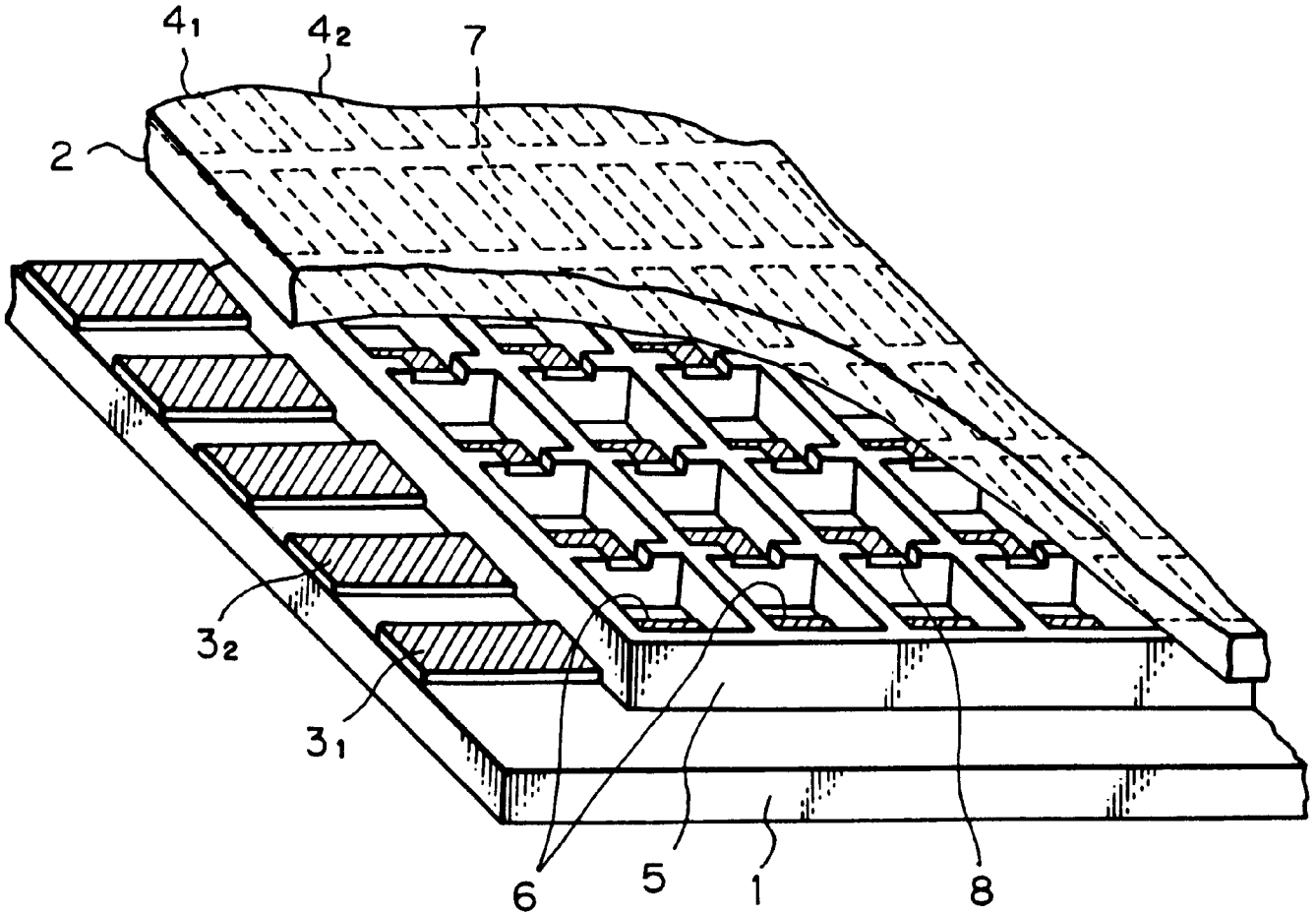
FIG. 2 is a schematic perspective view of the conventional DC-PDP.
Figure 3:
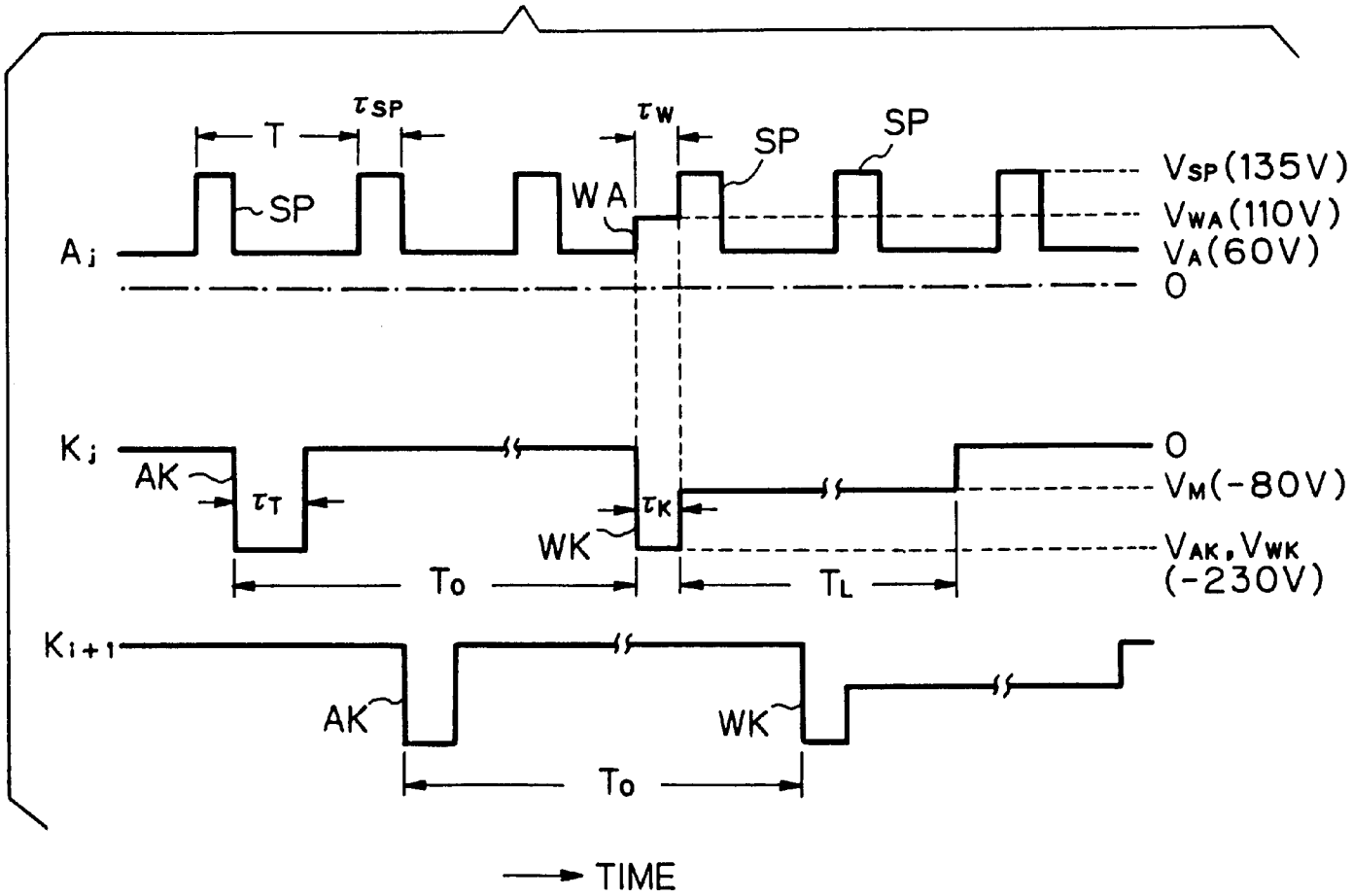
FIG. 3 is a waveform chart useful for understanding a memory drive scheme of the conventional DC-PDP shown in FIG. 2.
Figure 5:
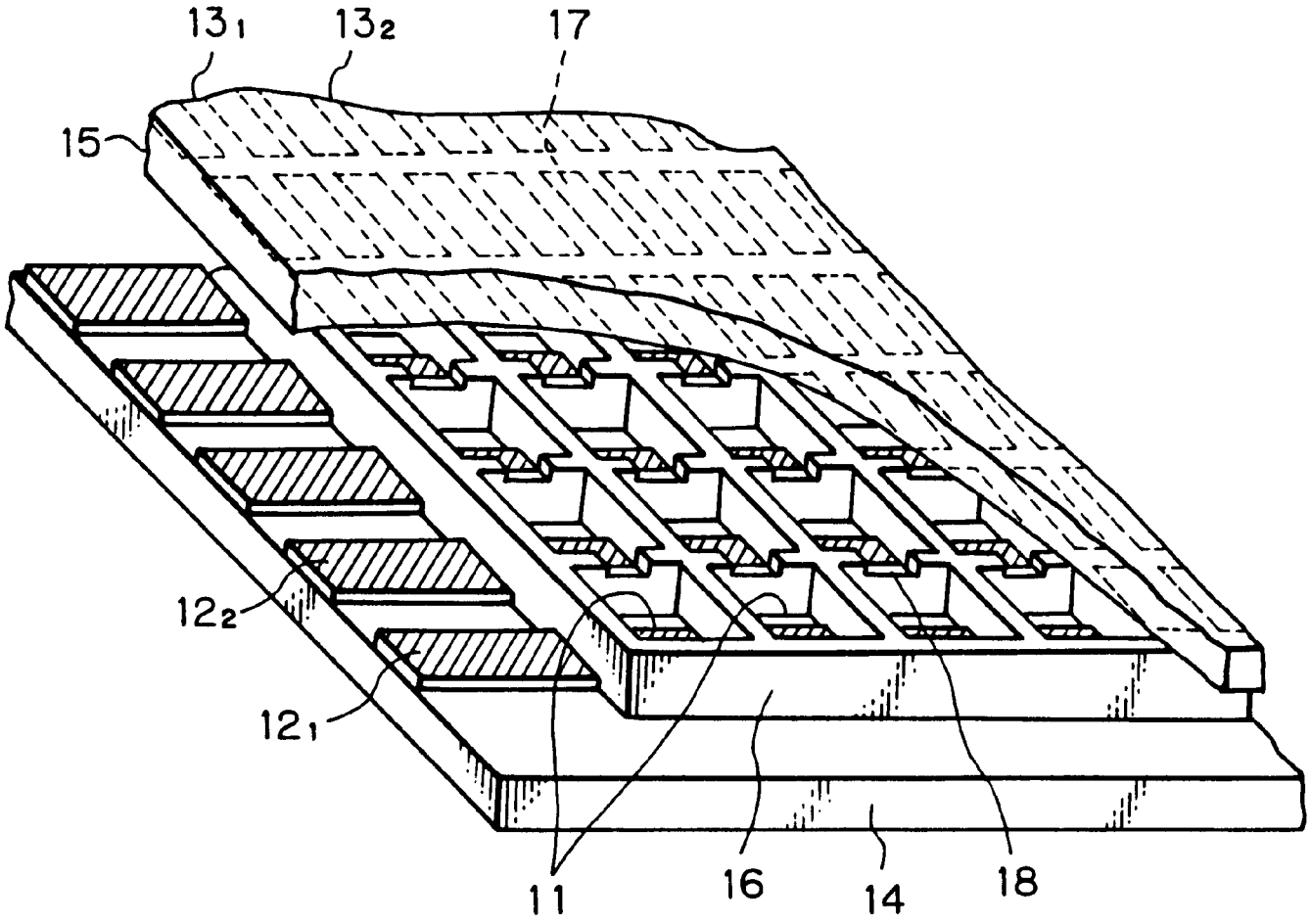
FIG. 5 is a schematic perspective view, similar to FIG. 2, of the DC-PDP shown in FIG. 4.

Now referring to FIG. 5, which is a schematic perspective view of the DC-PDP 10 shown in FIG. 4, the DC-PDP 10 is arranged, in a similar fashion to that of FIG. 2, between a rear plate 14 and a front plate 15 functioning as the second plate and the first plate, respectively. The linear cathodes $\mathbf{12}_1$-$\mathbf{12}_I$ are arranged on the rear plate 14 substantially in parallel with one another. The anodes $\mathbf{13}_1$-$\mathbf{13}_J$ are arranged on the front plate 15 substantially in parallel with one another. The cathodes $\mathbf{12}_1$-$\mathbf{12}_I$ and the anodes $\mathbf{13}_1$-$\mathbf{13}_J$ are located over adjacent each other in an intersecting relation. A barrier 16 is interposed between the rear plate 14 and the front plate 15 to provide a certain interval therebetween. A mixed gas of, for example, helium (He) and xenon (Xe), as the discharge gas, is enclosed between the rear plate 14 and the front plate 15.

Discharge cells 11 are provided at the cross points of the cathodes $\mathbf{12}_1$-$\mathbf{12}_I$ and the anodes $\mathbf{13}_1$-$\mathbf{13}_J$. A phosphor 7 is disposed for each discharge cell 11 in each of the areas in which the front plate 15 is adjacent to the respective anodes $\mathbf{13}_1$-$\mathbf{13}_J$. The respective discharge cells 11 are partitioned by the barrier 16. In the barrier 16 partitioning the adjacent discharge cells 11, there are formed cut sections in a direction in which each of the linear anodes $\mathbf{13}_1$-$\mathbf{13}_J$ extends, to provide priming slits 18 each serving as a space for coupling the adjacent discharge cells 11 to one another.

Figure 6:
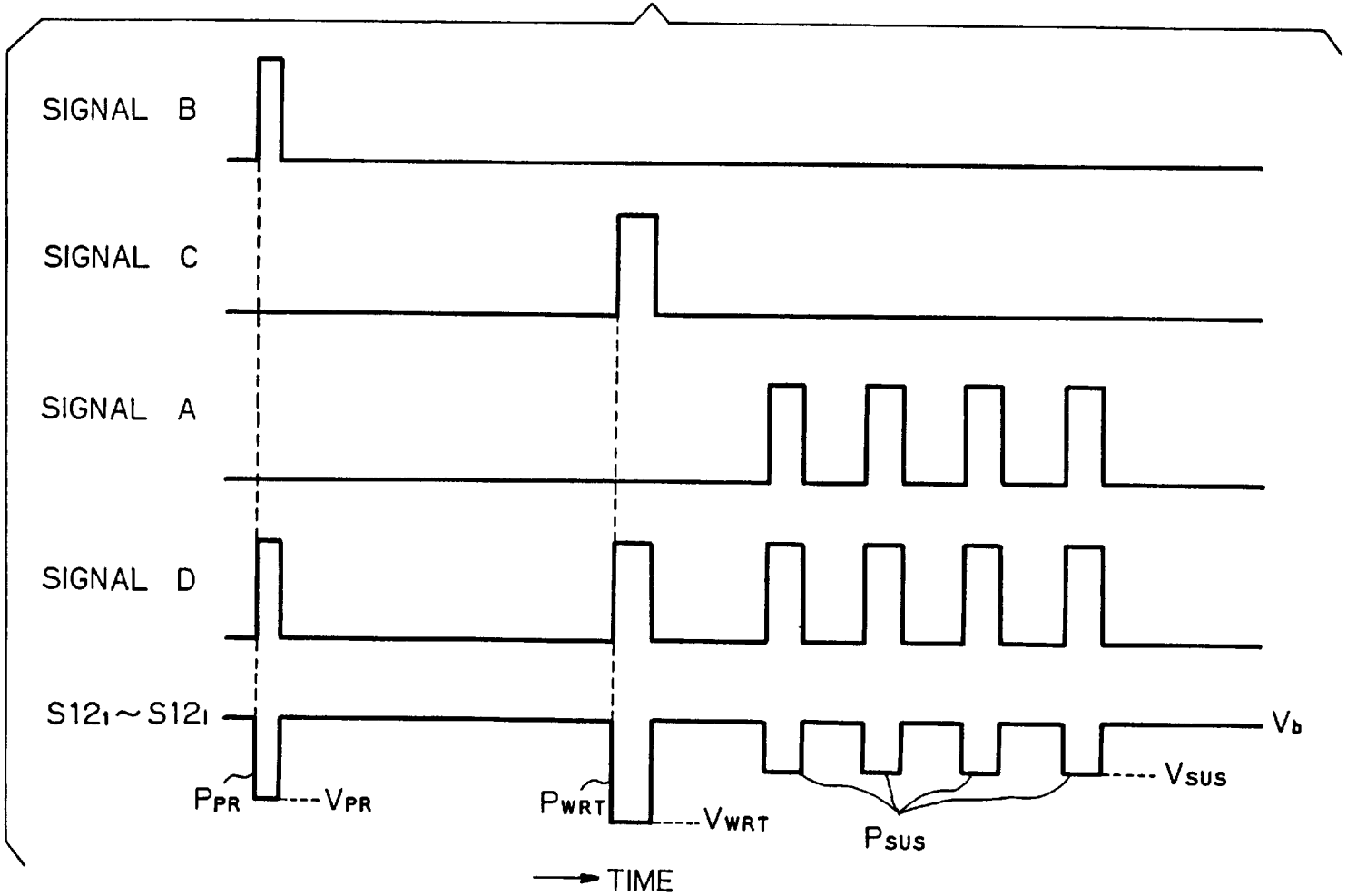
FIG. 6 is a waveform chart useful for understanding the scan signals $S12_1$- $S12_I$ shown in FIG. 4.

Referring to FIG. 6, which is a waveform chart useful for understanding the scan signals $S\mathbf{12}_1$-$S\mathbf{12}_I$ shown in FIG. 4, when the timing signal A is of a high level, the transistor 42 turns on, so that the scan signals $S\mathbf{12}_1$- $S\mathbf{12}_I$ take a potential $V_{SUS}$. When the timing signal B is of the high level, the transistor 43 turns on, so that the scan signals $S\mathbf{12}_1$-$S\mathbf{12}_I$ take the potential $V_{PR}$. When the timing signal C is of its high level, the transistor 44 turns on, so that the scan signals $S\mathbf{12}_1$-$S\mathbf{12}_I$ take the potential $V_{WRT}$. When the timing signal C is of its low level, the transistor 45 turns on, so that the scan signals $S\mathbf{12}_1$- $S\mathbf{12}_I$ take the potential $V_b$. The use of these four types of transistors 42–45 makes it possible to form on each of the scan signals $S\mathbf{12}_1$-$S\mathbf{12}_I$ a plurality of sustain pulses $P_{SUS}$, the priming scan pulse $P_{PR}$ and the write scan pulse $P_{WRT}$.

Figure 1:
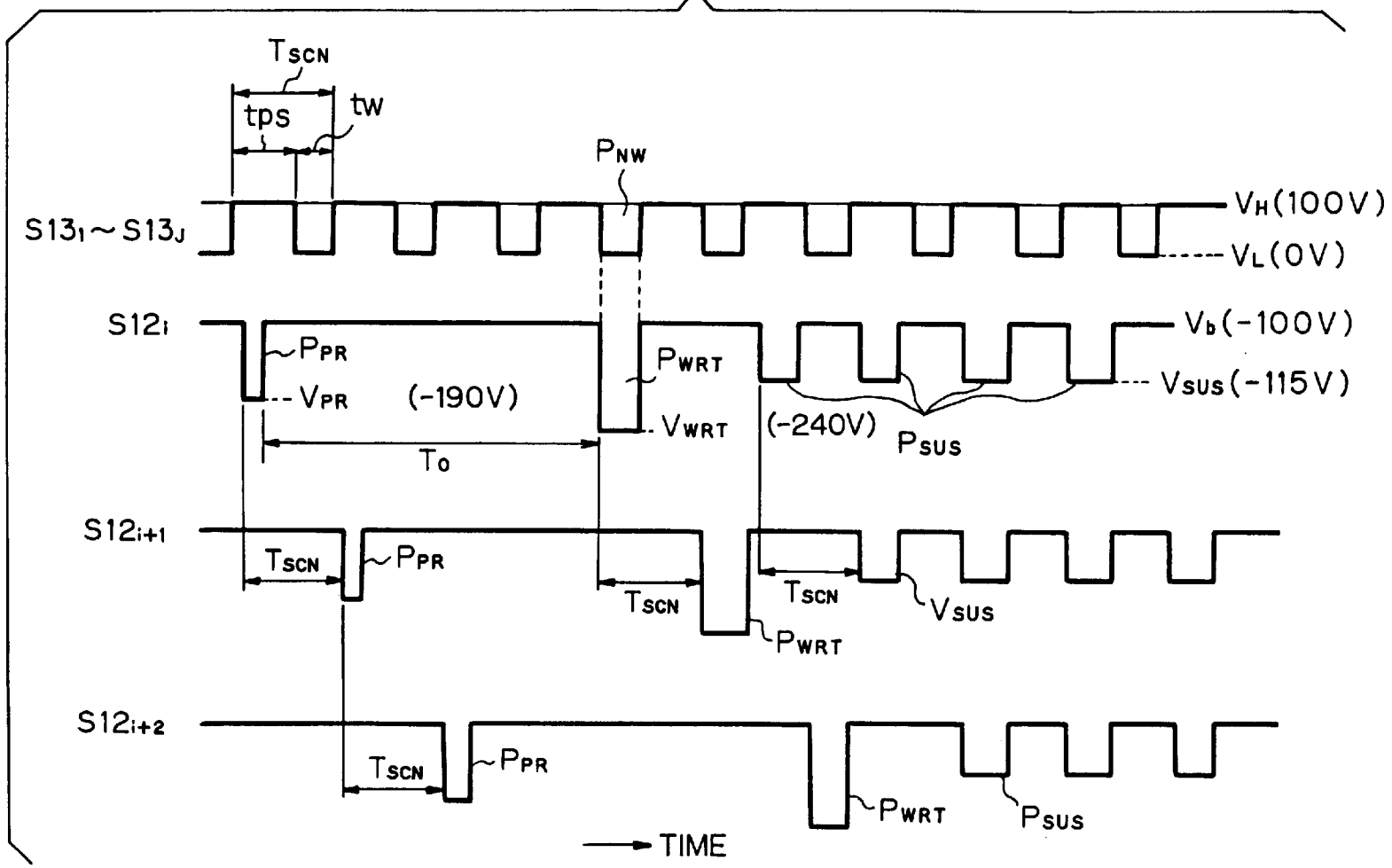
FIG. 1 is a time chart of data signals and scan signals, which is useful for understanding a memory drive scheme of a DC-PDP according to a first embodiment of the present invention.

FIG. 1 is a time chart of data signals and scan signals, which is useful for understanding a memory drive scheme of a DC-PDP according to the first embodiment of the present invention. The memory drive scheme of the DC-PDP 10 will be described referring to FIGS. 1 and 5 hereinafter.

In each of the scan signals $S\mathbf{12}_1$-$S\mathbf{12}_I$ output by the cathode drive circuit 30, there are formed the sustain pulses $P_{SUS}$, the priming scan pulse $P_{PR}$ and the write scan pulse $P_{WRT}$. For example, taking notice of the scan signal $S\mathbf{12}_i$ ($1 \leqq i \leqq I$), first, the priming scan pulse $P_{PR}$ is formed; then the write scan pulse $P_{WRT}$ is formed with a time interval To after formation of the priming scan pulse $P_{PR}$; and lastly, the plurality of sustain pulses $P_{SUS}$ are formed. In a similar fashion to that of the scan signal $S\mathbf{12}_i$, on the scan signal $S\mathbf{12}_{i+1}$, $S\mathbf{12}_{i+2}$, . . . , there are formed pulses $P_{PR}$, $P_{WRT}$ and $P_{SUS}$ analogous to those of the scan signal $S\mathbf{12}_i$ with a delay of one scan period of time $T_{SCN}$ with respect to the scan signal $S\mathbf{12}_i$ one by one on a sequential shift basis, respectively. This one scan period of time $T_{SCN}$ is, for example, 4 μs.

On the other hand, the data signals $S\mathbf{13}_1$-$S\mathbf{13}_J$ output by the anode drive circuit 20 are signals, which are each a non-write pulse $P_{NW}$ having an off-lever and which are applied only when a discharge is not formed during a period of the write scan pulse $P_{WRT}$. Specifically, when a discharge is not to be formed during an applying period of the write scan pulse $P_{WRT}$, the data signal is given by a potential $V_L$ (e.g. 0 V) serving as an off-level. On the other hand, the data signal is given by a potential $V_H$ (e.g. 100 V) serving as an on-level when a write discharge is to be formed and during another period. Those scan signals $S12_1$-$S12_I$ and data signals $S13_1$-$S13_J$ are used to drive the DC-PDP 10.

A potential (e.g. 290 V) between the potential $V_H$ of the data signals $S13_1$-$S13_J$ on the anodes $13_1$-$13_J$ and the potential $V_{PR}$ of the priming scan pulse $P_{PR}$ applied to the scan signal $S12_i$ on the cathode 12 causes forcibly a short time of priming discharge on an entire line of discharge cells 11. Further, the scan signals $S12_{i+1}$, $S12_{i+2}$, . . . , are used to sequentially apply the priming scan pulse $P_{PR}$ to the cathodes $12_{i+1}$, $12_{i+2}$, . . . , thereby sequentially shifting the priming discharge. At that time, the charged particles generated by the priming discharge are diffused passing through the priming slits 18 to the adjacent discharge cells 11. This causes the adjacent discharge cell 11 also to be in a state in which the priming discharge easily occurs. Thus, it is possible to implement a stable shift of the priming discharge.

After formation of the potential $V_{PR}$ of the priming scan pulse $P_{PR}$ on the scan signal $S12_i$, the scan signal $S12_i$ is of the potential $V_b$. Thus, the potential $V_b$ is applied to the cathode $12_i$, so that the priming discharge is temporarily stopped. In this condition, the number of charged particles in the discharge cells 11 is decreased with the passage of time. After maintaining the erasing condition during a period of time $T_0$, the write discharge potential $V_{WRT}$ of the write scan pulse $P_{WRT}$ is applied to the cathode $12_i$. At that time, the potential $V_H$ is maintained for the data signals for the discharge cells, which are to be subjected to a writing, among the discharge cells connected to the cathode $12_i$. Thus, a potential ($V_H$–$V_{WRT}$=340 V) for initiating the write discharge is applied to the discharge cells to be subjected to the writing, thereby forming the write discharge. This write discharge is formed promptly, since the charged particles produced in the priming discharge before the period of time $T_0$ remain still yet.

By the way, the charged particles and the like are produced also in the write discharge. While the charged particles and the like are decreased with the passage of time, a lot of charged particles remain in the discharge cells immediately after the write discharge. Consequently, after the write discharge, it is possible to implement the discharge even with the sustain discharge voltage ($V_H$–$V_{SUS}$=215 V) lower than the write discharge voltage ($V_H$–$V_{WRT}$=340 V), thereby performing intermittently the sustain discharge by the sustain pulse $P_{SUS}$.

In order to stop the sustain discharge, an application of the sustain pulse $P_{SUS}$ to the cathode $12_j$ is stopped. On the other hand, when the write discharge is not to be formed, the potential $V_L$ of the non-write pulse $P_{NW}$ is applied to the anode $13_j$ in synchronism with the write scan pulse $P_{WRT}$. As a result, the non-write pulse $P_{NW}$ is formed on the data signal so that the discharge cell 11, which is not to be subjected to a writing, is given by a voltage ($V_L$–$V_{WRT}$=140 V) with which the discharge is not initiated. This may suppress formation of the write discharge. Thus, even if the potential for the sustain pulse $P_{SUS}$ is applied to the cathode $12_i$, an intermittent discharge does not occur through the sustain discharge voltage lower than the write discharge voltage, since the charged particles or the like within the discharge cells almost disappear. The one scan period of time $T_{SCN}$ is provided in such a manner that a period of time $t_{PS}$ assigned to the sustain discharge and the priming discharge does not overlap with a period of time $t_W$ assigned to the write discharge, so that a reliable discharge can be formed.

As described above, in the memory drive scheme of a DC-PDP according to the first embodiment of the present invention, the scan signal $S12_i$ to be applied to the cathode $12_i$ comprises the priming scan pulse $P_{PR}$ for sequentially forming the priming discharge, the write scan pulse $P_{WRT}$ to be applied at an interval of a certain period of time after occurrence of the priming scan pulse $P_{PR}$, and the sustain pulse $P_{SUS}$ train to be applied subsequent to the write scan pulse $P_{WRT}$; and further the data signals $S13_1$-$S13_J$ to be applied respectively to the anodes $13_1$-$13_J$ are each of a bi-level signal having its off-level of potential $V_L$ in which only when the write discharge is not to be formed, the non-write pulse $P_{NW}$ is formed in synchronism with the write scan pulse $P_{WRT}$, and its on-level of potential $V_H$ which appears when a write discharge is to be formed and during another period of time. Thus, according to the first embodiment of the present invention, it is possible to expect the following effects (1) and (2):

(1) Since it is sufficient for the memory drive scheme of a DC-PDP according to the first embodiment that the priming scan pulse $P_{PR}$ and the sustain pulses $P_{SUS}$ applied to the cathodes $12_1$-$12_I$ do not overlap with the non-write pulse $P_{NW}$, the one scan period of time $T_{SCN}$ may simply be divided into two periods of time of the period of time $t_W$ assigned to the write discharge, and the period of time $t_{PS}$ assigned to the sustain discharge and the priming discharge. Thus, it is possible to assign the sustain discharge and the priming discharge to the same period of time, thereby increasing the degree of freedom in setting up of the respective pulse width. This makes it possible to perform a sufficient gray scale display by reducing an access time for a line. Further, for example, hitherto, since there is a limit as to setting up of the pulse width, there is a need to provide a higher potential to generate the priming discharge. However, there is a possibility that this involves an erroneous discharge. On the other hand, according to the first embodiment of the invention, there is provided a large degree of freedom in setting up of the pulse width. This feature makes it possible to select a condition capable of implementing a stable discharge operation, thereby realizing an excellent display quality involving no erroneous discharge.

(2) Waveforms of the data signals $S13_1$-$S13_J$ applied to the anodes $13_1$-$13_J$ are simplified as compared with the conventional ones. Thus, it is possible to reduce the cost of the anode drive circuit 20.

Second embodiment

Figure 7:
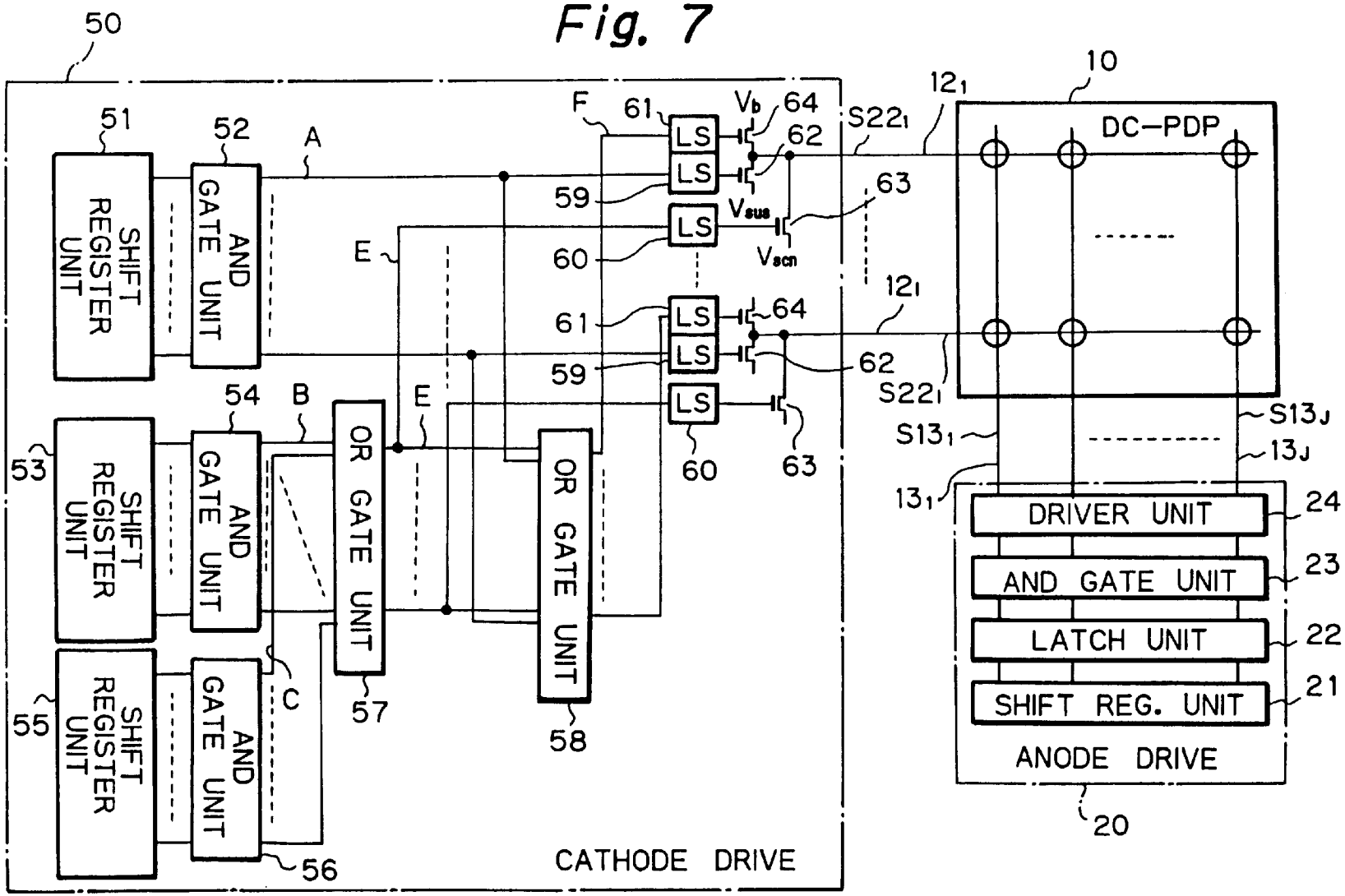
FIG. 7 is a schematic circuit diagram, similar to FIG. 4, of a DC-PDP and drive circuits according to a second embodiment of the present invention.

FIG. 7 is a schematic circuit diagram of a DC-PDP and drive circuits according to an alternative, second embodiment of the present invention. In FIG. 7, the like parts are denoted by the same reference numerals or symbols as those of FIG. 4. The DC-PDP 10 in FIG. 7 is similar in structure to that of FIG. 4 related to the first embodiment of the present invention. Thus, a redundant description of the DC-PDP 10 will be omitted.

Connected to the anodes $13_1$-$13_J$ are an anode drive circuit 20 for driving the anodes $13_1$-$13_J$ on a voltage basis. The anode drive circuit 20 is also similar in structure to that of FIG. 4 related to the first embodiment of the invention. Also, a redundant description of the anode drive circuit 20 will thus be omitted.

The cathodes $12_1$-$12_I$ are connected to a cathode drive circuit 50 for applying scan signals $S22_1$-$S22_I$ to the cathodes $12_1$-$12_I$, respectively. The cathode drive circuit 50 comprises a shift register unit 51 for generating a plurality of timing signals A to form sustain pulses $P_{SUS}$ on the scan signals $S22_1$-$S22_I$, an AND gate unit 52 connected to the shift register unit 51, a shift register unit 53 for generating a plurality of timing signals B to form priming scan pulses $P_{PR}$ on the scan signals $S22_1$-$S22_I$, an AND gate unit 54 connected to the shift register unit 53, a shift register unit 55 for generating a plurality of timing signals C to form write scan pulses $P_{WRT}$ on the scan signals $S22_1$-$S22_I$, an AND gate unit 56 connected to the shift register unit 55, an OR gate unit 57 for generating a plurality of timing signals E which are formed by a logical OR operation, namely a logical addition of the signals B and C, and an OR gate unit 58 for generating a plurality of timing signals F which are formed by a logical OR operation, namely a logical addition of the signals E and A. Each of the numbers of signals A-C, E and F is the same as that of the cathodes $12_1$-$12_I$. The signals E output from the OR gate unit 57 are each used to control a period of time for applying a potential $V_{SCN}$, which will be described later, to the associated one of the cathodes $12_1$-$12_I$. The signals output from the OR gate unit 58 are each used to control a period of time for applying a potential $V_b$, which will also be described later, to the associated one of the cathodes $12_1$-$12_I$.

The AND gate unit 52 has outputs connected to a plurality of level shift (LS) circuits 59 each for converting the level of the associated signal A, the LS circuits 59 being associated with the cathodes $12_1$-$12_I$, respectively. The OR gate unit 57 has outputs connected to a plurality of level shift (LS) circuits 60 each for converting the level of the associated signal E, the LS circuits 60 being associated with the cathodes $12_1$-$12_I$, respectively. The OR gate unit 58 has outputs connected to a plurality of level shift (LS) circuits 61 each for converting the level of the associated signal F, the LS circuits 61 being associated with the cathodes $12_1$-$12_I$, respectively.

Each of the level shift (LS) circuits 59 has an output connected to an associated one of the high withstand voltage of transistors 62 for controlling turn-on and turn-off between the cathodes $12_1$-$12_I$ and the sustain pulse potential $V_{SUS}$ (e.g. −115 V) in accordance with the signal A subjected to the level conversion. Each of the level shift (LS) circuits 60 has an output connected to an associated one of the high withstand voltage transistors 63 for controlling turn-on and turn-off between the cathodes $12_1$-$12_I$ and a priming discharge and write discharge potential $V_{SCN}$ (e.g. −240 V) in accordance with the signal E subjected to the level conversion. Each of the level shift (LS) circuits 61 has an output connected to an associated one of the high withstand voltage transistors 64 for controlling turn-on and turn-off between the cathodes $12_1$-$12_I$ and a bias potential $V_b$ (e.g. −100 V) in accordance with the signal F subjected to the level conversion.

Figure 8:
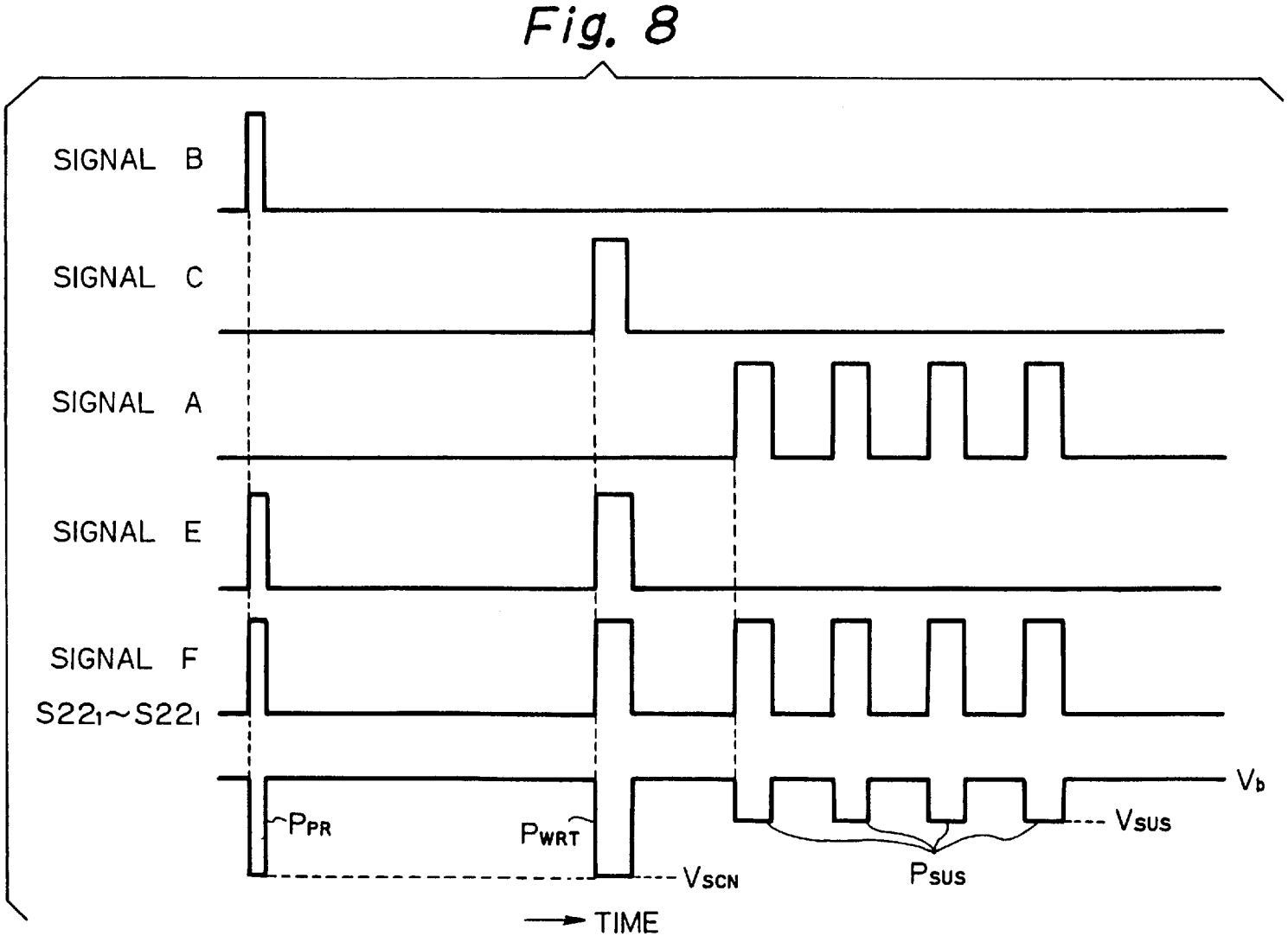
FIG. 8 is a waveform chart, similar to FIG. 6, useful for understanding the scan signals $S22_1$-$S22_I$ shown in FIG. 7.

FIG. 8 is a waveform chart useful for understanding the scan signals $S22_1$-$S22_I$ shown in FIG. 7. When the timing signal A is of its high level, the transistor 62 turns on, so that the scan signals $S22_1$-$S22_I$ take the potential $V_{SUS}$. When the timing signal E is of its high level, the transistor 63 turns on, so that the scan signals $S22_1$-$S22_I$ take the potential $V_{SCN}$. When the timing signal F is of its low level, the transistor 64 turns on, so that the scan signals $S22_1$-$S22_I$ take potential $V_b$. The use of these three types of transistors 62-64 makes it possible to form on each of the scan signals $S22_1$-$S22_I$ a plurality of sustain pulses $P_{SUS}$, the priming scan pulse $P_{PR}$ and the write scan pulse $P_{WRT}$, the priming scan pulse $P_{PR}$ and the write scan pulse $P_{WRT}$ having the same potential.

Figure 9:
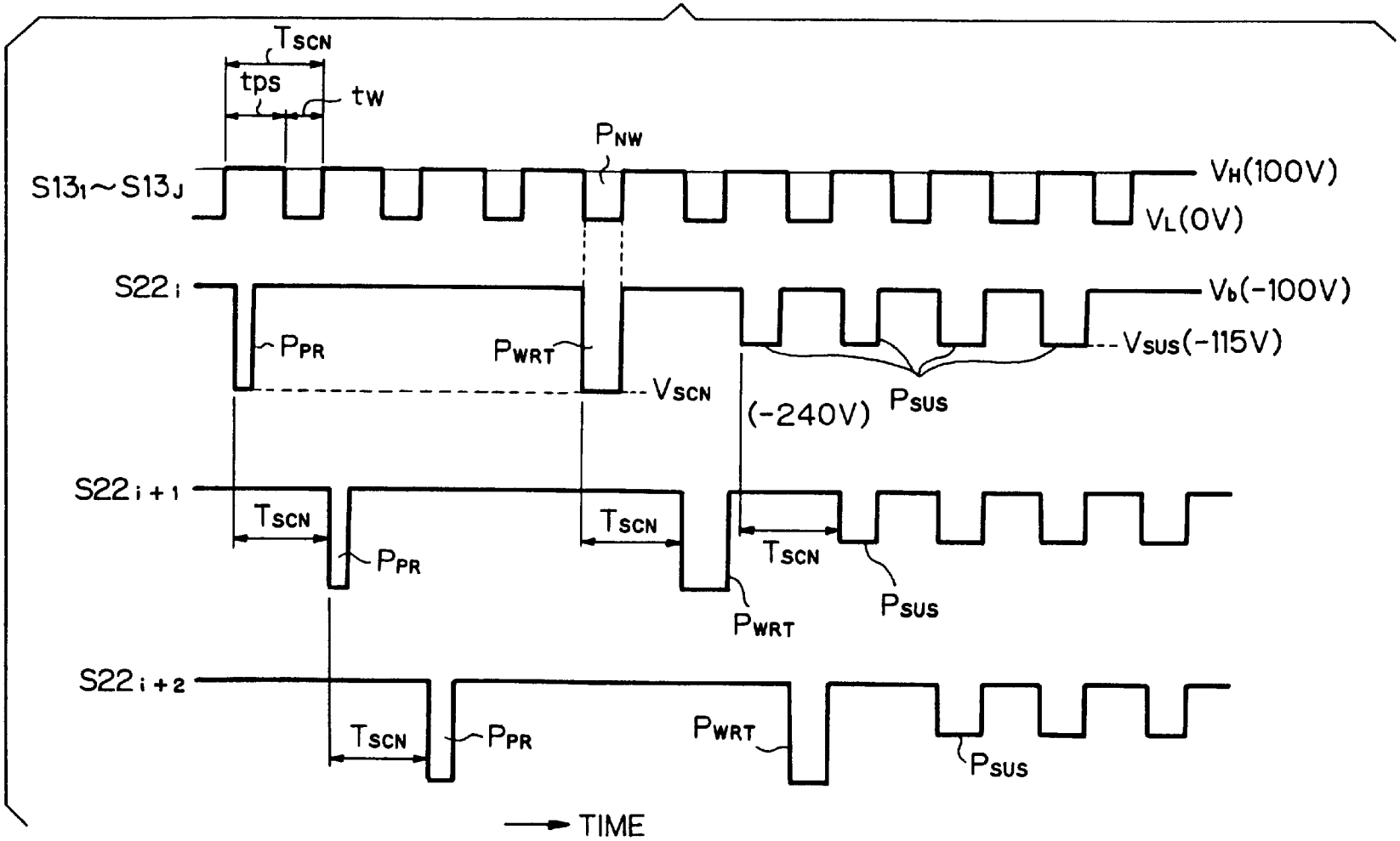
FIG. 9 is a time chart of data signals and scan signals, which is useful for understanding a memory drive scheme of a DC-PDP according to the second embodiment of the invention.

FIG. 9 is a time chart of data signals and scan signals, which is useful for understanding a memory drive scheme of a DC-PDP according to the second embodiment of the present invention. The memory drive scheme of the DC-PDP 10 will be described referring to FIGS. 9 and 5 hereinafter.

On each of the scan signals $S22_1$-$S22_I$ output from the cathode drive circuit 50, there are formed the sustain pulses $P_{SUS}$, the priming scan pulse $P_{PR}$ and the write scan pulse $P_{WRT}$. For example, taking notice of the scan signal $S22_i$ ($1 \leqq i \leqq I$), first, the priming scan pulse $P_{PR}$ is formed; then the write scan pulse $P_{WRT}$ is formed with a time interval To after formation of the priming scan pulse $P_{PR}$; and lastly, the plurality of sustain pulses $P_{SUS}$ are formed. In a similar fashion to that of the scan signal $S22_i$, on the scan signal $S22_{i+1}$, $S22_{i+2}$, . . . , there formed pulses $P_{PR}$, $P_{WRT}$ and $P_{SUS}$ analogous to those of the scan signal $S22_i$ with a delay of one scan period of time $T_{SCN}$ with respect to the scan signal $S22_i$ one by one on a sequential shift basis, respectively. This one scan period of time $T_{SCN}$ is, for example, 4 μs.

On the other hand, the data signals $S13_1$-$S13_J$ outputted from the anode drive circuit 20 are signals which each are a non-write pulse $P_{NW}$ housing an off-level and which are applied only when a discharge is not formed during a period of the write scan pulse $P_{WRT}$. Specifically, when a discharge is not to be formed during an applying period of the write scan pulse $P_{WRT}$, the data signal is given by a potential $V_L$ (e.g. 0 V) serving as an off-level. On the other hand, the data signal is given by a potential $V_H$ (e.g. 100 V) serving as an on-level when a write discharge is to be formed and during another period. Those scan signals $S22_1$-$S22_I$ and data signals $S13_1$-$S13_J$ are used to drive the DC-PDP 10.

A potential (e.g. $V_H - V_{SCN} = 340$ V) between the potential $V_H$ of the data signals $S13_1$-$S13_J$ on the anodes $13_1$-$13_J$ and the potential $V_{SCN}$ of the priming scan pulse $P_{PR}$ applied to the scan signal $S22_i$ on the cathode $12_i$ causes forcibly a short time of priming discharge on an entire line of discharge cells 11. In this case, the voltage for the priming discharge is higher than that (e.g. 290 V) of the prior art and the first embodiment. Consequently, in spite of the fact that the maximum amplitude of the scan signals $S22_1$-$S22_I$ on the cathodes $12_1$-$12_I$ is the same as that (e.g. 140 V) of the first embodiment, it is possible to form the discharge at higher speed as compared with the prior art and the first embodiment.

Sequential application of the priming scan pulse $P_{PR}$ to the adjacent cathodes $12_{i+1}$, $12_{i+2}$, . . . , causes the priming discharge to be sequentially shifted. At that time, the charged particles generated by the priming discharge are diffused passing through the priming slits 18 to the adjacent discharge cells 11. This causes the adjacent discharge cell 11 also to be in a state in which the priming discharge easily occurs. Thus, it is possible to implement a stable shift of the priming discharge.

After application of the potential $V_{SCN}$ to the cathode $12_i$ through the scan signal $S22_i$, the potential $V_b$ is applied to the cathode $12_i$, so that the priming discharge is temporarily stopped. In this condition, the number of charged particles in the discharge cells 11 is decreased with the passage of time. After maintaining the erasing condition during a period of time $T_0$, the potential $V_{SCN}$ of the write scan pulse $P_{WRT}$ is applied to the cathode $12_i$. At that time, the potential $V_H$ is maintained for the data signals for the discharge cells which are to be subjected to a writing, among the discharge cells connected to the cathode $12_i$. Thus, a potential ($V_H - V_{WRT} =$ 340 V) for initiating the write discharge is applied again to the discharge cells to be subjected to writing, thereby forming the write discharge. This write discharge is formed promptly, since the charged particles produced in the priming discharge before the period of time $T_0$ remain still yet.

By the way, the charged particles and the like are produced also in the write discharge. While the charged particles and the like are decreased with the passage of time, a lot of charged particles remain in the discharge cells immediately after the write discharge. Consequently, after the write discharge, it is possible to implement the discharge even with the sustain discharge voltage ($V_H-V_{SUS}$=215 V) lower than the write discharge voltage ($V_H-V_{SCN}$=340 V), thereby performing intermittently the sustain discharge by the sustain pulse $P_{SUS}$.

In order to stop the sustain discharge, an application of the sustain pulse $P_{SUS}$ to the cathode $\mathbf{12}_i$ is stopped. On the other hand, when the write discharge is not to be formed, the potential $V_L$ of the non-write pulse $P_{NW}$ is applied to the anode $\mathbf{13}_j$ in synchronism with the write scan pulse $P_{WRT}$. As a result, the non-write pulse $P_{NW}$ is formed on the data signal so that the discharge cell 11, which is not to be subjected to a writing, is given by a voltage ($V_L-V_{SCN}$=140 V) with which the discharge is not initiated. This may suppress formation of the write discharge. Thus, even if the potential $V_{SUS}$ for the sustain pulse $P_{SUS}$ is applied to the cathode $\mathbf{12}_i$, then an intermittent discharge does not occur through the sustain discharge voltage lower than the write discharge voltage, since the charged particles or the like within the discharge cells almost disappear.

Also in this case, the one scan period of time $T_{SCN}$ is provided in such a manner that a period of time $t_{PS}$ assigned to the sustain discharge and the priming discharge does not overlap with a period of time $t_W$ assigned to the write discharge, so that a reliable discharge can be formed.

As described above, according to the memory drive scheme of a DC-PDP of the second embodiment of the invention, in a similar fashion to that of the first embodiment of the invention, each of the scan signals $\mathbf{S22}_1$-$\mathbf{S22}_I$ comprises the priming scan pulse $P_{PR}$, the write scan pulse $P_{WRT}$ and the sustain pulse $P_{SUS}$ train; and further the data signals $\mathbf{S13}_1$-$\mathbf{S13}_J$ to be applied respectively to the anodes $\mathbf{13}_1$-$\mathbf{13}_J$ are each of a two-level signal having an off-level of potential $V_L$ in which only when the write discharge is not to be formed, the non-write pulse $P_{NW}$ is formed in synchronism with the write scan pulse $P_{WRT}$, and an on-level of potential $V_H$ which appears when a write discharge is to be formed and during another period of time. Further, according to the second embodiment of the invention, the priming scan pulse $P_{PR}$ and the write scan pulse $P_{WRT}$ on each of the scan signals $\mathbf{S22}_1$- $\mathbf{S22}_I$ to be applied respectively to the cathodes $\mathbf{12}_1$-$\mathbf{12}_I$ are equal to one another in potential, such as the potential $V_{SCN}$. It is thus possible to expect the following effects (3) and (4) in addition to the effects (1) and (2) discussed with reference to the first embodiment of the present invention:

(3) Signal waves of the scan signals $\mathbf{S22}_1$-$\mathbf{S22}_I$ to be applied respectively to the cathodes $\mathbf{12}_1$-$\mathbf{12}_I$ are simplified. This makes it possible to reduce the number of transistors in the output stage of the cathode drive circuit 50. Thus, it is possible to decrease cost of the cathode drive circuit 50.

(4) It is possible to select the priming discharge voltage and the write discharge voltage to be equal to one another without increasing the maximum amplitude of the scan signals $\mathbf{S22}_1$-$\mathbf{S22}_I$ to be applied respectively to the cathodes $\mathbf{12}_1$-$\mathbf{12}_I$. Thus, it is possible to form the discharge at sufficiently high speed even with the cathode drive circuit implemented in the low cost.

Incidentally, the present invention is not to be restricted by the particular illustrative embodiments described above. It is possible to modify the embodiments. For example, it is acceptable that the potentials $V_H$, $V_{SUS}$, $V_{SCN}$, $V_{PR}$, $V_b$ and the like are other potentials, if it is feasible to perform the write discharge, the sustain discharge and the priming discharge. Further, the structure of the cathode drive circuits 30 and 50 and the anode drive circuit 20 are not restricted to those shown in FIGS. 4 and 7. For example, it is acceptable that they are arranged in such a manner that the DC-PDP 10 is divided for a drive.

While the present invention has been described with reference to the particular illustrative embodiments, it is not to be restricted by those embodiments. It is to be appreciated that those skilled in the art can change or modify the embodiments without departing from the scope and spirit of the present invention.

What is claimed is:

1. A system of memory driving a plasma display panel, comprising:

a d.c. type of plasma display panel comprising a first plate and a second plate placed over and adjacent the first plate, a group of data electrodes constituting a plurality of linear electrodes arranged on said first plate in parallel with one another, a group of scan electrodes constituting a plurality of linear electrodes arranged on said second plate in such a manner that said scan electrode group is placed over and adjacent said data electrode group and is substantially perpendicular to said data electrode group, and a plurality of discharge cells disposed at intersections of the respective data electrodes and the respective scan electrodes, each of said plurality of discharge cells performing a priming discharge, a write discharge and a plurality of number of times of sustain discharge subsequent to the write discharge in accordance with a potential between an associated data electrode and an associated scan electrode, and with a discharge gas being enclosed between said first plate and said second plate and also within the respective discharge cells; and a timing generator for sequentially applying to the scan electrodes scan signals each comprising a priming scan pulse for generating the priming discharge, a write scan pulse for generating the write discharge, with the write scan pulse occurring with a delay of a predetermined time with respect to the priming scan pulse, and a sustain pulse train for generating the sustain discharge, with the sustain pule train occurring with a delay of a predetermined time with respect to the write scan pulse, and with the priming scan pulse, the write scan pulse and the sustain pulse train being sequentially shifted on a time basis for each scan signal;

said timing generator applying to each of said data electrodes a data signal in which, only when the write discharge is not to be generated, is a non-write pulse formed, which offers a turn-off level during an applying period of time for the write scan pulse, and a turn-on level is maintained when the write discharge is to be generated and during another period of time except the applying period of time for the write scan pulse.

2. The system according to claim 1, wherein said timing generator generates the priming scan pulse and the write scan pulse in the scan signal which are substantially equal to each other in their potential.

3. A method of memory-driving a d.c. type of plasma display panel comprising a first plate and a second plate placed over and adjacent the first plate, a group of data electrodes constituting a plurality of linear electrodes arranged on said first plate in parallel with one another, a group of scan electrodes constituting a plurality of linear electrodes-arranged on said second plate in such a manner that said scan electrode group is placed over and adjacent said data electrode group and is substantially perpendicular to said data electrode group, and a plurality of discharge cells disposed at intersections of the respective data electrodes and the respective scan electrodes, with each of said plurality of discharge cells performing a priming discharge, a write discharge and a plurality of number of times of sustain discharge subsequent to the write discharge in accordance with a potential between an associated data electrode and an associated scan electrode, and with a discharge gas being enclosed between said first plate and said second plate and also within the respective discharge cells, said method comprising the steps of:

sequentially applying to the scan electrodes scan signals each comprising a priming scan pulse for generating the priming discharge, a write scan pulse for generating the write discharge, with the write scan pulse occurring with a delay of a predetermined time with respect to the priming scan pulse, and a sustain pulse train for generating the sustain discharge, with the sustain pulse train occurring with a delay of a predetermined time with respect to the write scan pulse, and with the priming scan pulse, the write scan pulse and the sustain pulse train being sequentially shifted on a time basis for each scan signal; and applying to each of said data electrodes a data signal in which only when the write discharge is not to be generated, which non-write pulse offers a turn-off level during an applying period of time for the write scan pulse, and a turn-on level is maintained when the write discharge is to be generated and during another period of time except the applying period of time for the write scan pulse.

4. The method according to claim 1, wherein the priming scan pulse and the write scan pulse in the scan signal are substantially equal to each other in their potential.

* * * * *